US006718042B1

(12) United States Patent
McGrath

(10) Patent No.: US 6,718,042 B1
(45) **Date of Patent: *Apr. 6, 2004**

(54) DITHERED BINAURAL SYSTEM

(75) Inventor: David Stanley McGrath, Bondi (AU)

(73) Assignee: Lake Technology Limited, Ultimo (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/956,009

(22) Filed: Oct. 22, 1997

(30) Foreign Application Priority Data

Oct. 23, 1996 (AU) ..... PO3162

(51) Int. Cl.[7] ..... H04R 5/02; H04R 5/00; H04R 1/10

(52) U.S. Cl. ..... 381/310; 381/17; 381/74; 381/309

(58) Field of Search ..... 381/310, 74, 309, 381/17, 1

(56) References Cited

U.S. PATENT DOCUMENTS 3,962,543 A 6/1976 Blauert et al.
4,209,665 A * 6/1980 Iwahara ..... 381/310
5,136,651 A * 8/1992 Cooper et al. ..... 381/310
5,459,790 A * 10/1995 Scofield et al. ..... 381/18
5,495,534 A * 2/1996 Inanaga et al. ..... 381/310
6,021,205 A * 2/2000 Yamada et al. ..... 381/310
6,021,206 A * 2/2000 McGrath ..... 381/310
6,370,256 B1 * 4/2002 McGrath ..... 381/310
6,532,291 B1 * 3/2003 McGrath ..... 381/74

OTHER PUBLICATIONS

Wenzel et al., Localization using nonindividualized head–related transfer functions, Jul. 1993, Acoustical Society of America, pp. 111–123.*

* cited by examiner

*Primary Examiner*—Minsun Oh Harvey
*Assistant Examiner*—Laura A. Grier
(74) *Attorney, Agent, or Firm*—Dov Rosenfeld; Inventek

(57) ABSTRACT

A method for creating a multichannel audio signal that provides the impression of spatial sound is disclosed, the method comprising providing an expected multichannel audio output signal having spatialised soundfield components; perturbing the spatial components; and utilising the perturbed spatial components to determine the multichannel audio signal. The perturbations can be substantially in accordance with the expected head movements of listeners of the audio signal and can be derived from a group of listeners to the audio signal. The expected head movements also preferable include an added substantially random movement.

8 Claims, 4 Drawing Sheets

DITHERED BINAURAL SYSTEM

FIELD OF THE INVENTION

The present invention relates to processing sound signals having spatialised components which create a multidimensional environment for the sound. Further, the present invention relates to improving the reproduction of binaural (two channel) sound, particularly when it is desired to give a listener an impression of virtual sound sources being located some distance away from the listener.

BACKGROUND OF THE INVENTION

For a general reference to the field and on the problems associated with reproduction of sound having spatial components, reference is made to "A 3-D Sound Primer: directional hearing and stereo reproduction" by Gary S Kendall appearing in the Computer Music Journal, 19;4 at pages 23–46, Winter 1995.

Methods are generally known for the generation of binaural sound where headtracking of the listener's head movements is utilised to modify the processed output to provide a better impression of sound located some distance away from the listener. These methods include:

1. The "Headscape" program utilised in conjunction with the Huron Digital Audio Convolution Work Station both of which are available from the present assignee Lake DSP Pty Ltd and rely upon the smooth switching between pre-computed FIR filter responses in response to a listener's head turning.
2. U.S. patent application Ser. No. 08/723,614 filed Oct. 2, 1996 in the name of the present applicant and inventor and entitled "Methods and Apparatus for Processing Spatialised Audio" which describes a method for headtracked playback of B format "ambisonic" sound fields.
3. Existing products from other manufacturers which utilise rapidly changing head related transfer function (HRTF) filters to perform headtracked playback of binaural sound.

Each of these systems rely on arrangement similar to that disclosed in FIG. 1 herein in that a listener 2 utilises a pair of headphones 3 having an integrally mounted headtracking means 4 which tracks the orientation of the user's head 2. The headtracking means 4 is normally in communications with a headtracking unit 5 which continuously determines a current orientation of the user's head. This information 6 is output to the binaural processing system 7 which manipulates a series of audio inputs 8 to produce corresponding right 10 and left 11 output sound channels for playback to the user's head 3.

The disadvantage of the arrangement 1 of FIG. 1 is that a headtracking unit eg. 4, 5 must be provided and this adds a large degree of complexity and expensive to the arrangement 1. Further, most headphones in use today do not have any headtracking facility but are rather stereotype devices.

The arrangement 1 is primarily concerned with audio processing the input signals 8 so that there is an altering of corresponding outputs 10, 11 in response to the turning of the listener's head 2. This is provided as a means to create a more stable audio sound field so that the location of the virtual sounds around the listener do not change when a listener turns his/her head. Additionally, the audio processing systems generally provide a better illusion of sounds in front of the listener. Tracking the rotation of a listener's head greatly enhances the impression of frontal sounds, defeating the front-back confusion that commonly occurs with binaural sound and is a well known problem with the prior art.

SUMMARY OF THE INVENTION

It is an object of the present invention to provide an improved means of front-back discrimination of sounds to the listener without the need for the provision of an expensive headtracking unit. The removal of the headtracking from the playback process also has the advantageous effect of allowing a binaural signal, such as a stereo pair, to be utilised by one or more listeners without the need for any additional processing at the time of playback.

In accordance with the first aspect of the present invention there is provided a method for creating a multichannel audio signal that provides the impression of spatial sound, said method comprising:

providing an expected multichannel audio output signal having spatialised soundfield components;

perturbing said spatial components; and utilising said perturbed spatial components to determine said multichannel audio signal.

Preferably, the multichannel audio signal comprises two channels adapted for playback over headphones. Further, the perturbations preferably comprise a series of substantially random rotations, substantially in the horizontal plane. Further, the perturbations can be substantially in accordance with the expected head movements of listeners to the audio signal.

Methods disclosed include methods for deriving expected head movements from a group of listeners to the audio signal and subsequently using these movements with like audiences. As a further refinement, a random movement can be added to the expected head movement.

Preferably the invention works with large scale movements of sound sources and, as a refinement, the perturberances can be created such as to not incorporate any change in arrival time of simulated acoustic arrival times.

There is also a disclosed an apparatus for implementing the invention by means of a DSP arrangement or the like.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

Figure 1:
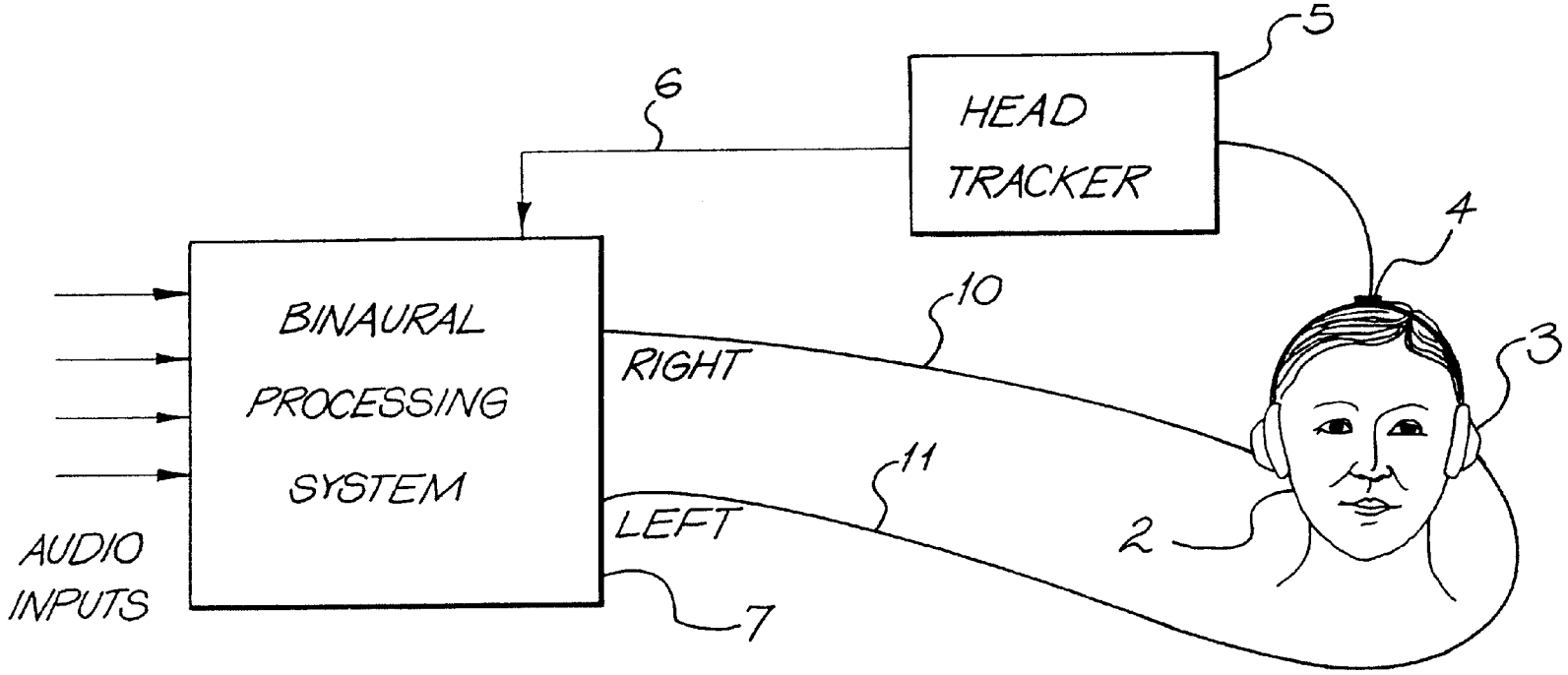
FIG. 1 (PRIOR ART)
FIG. 1 illustrates a head tracking arrangement utilised in the prior art.
Figure 2:
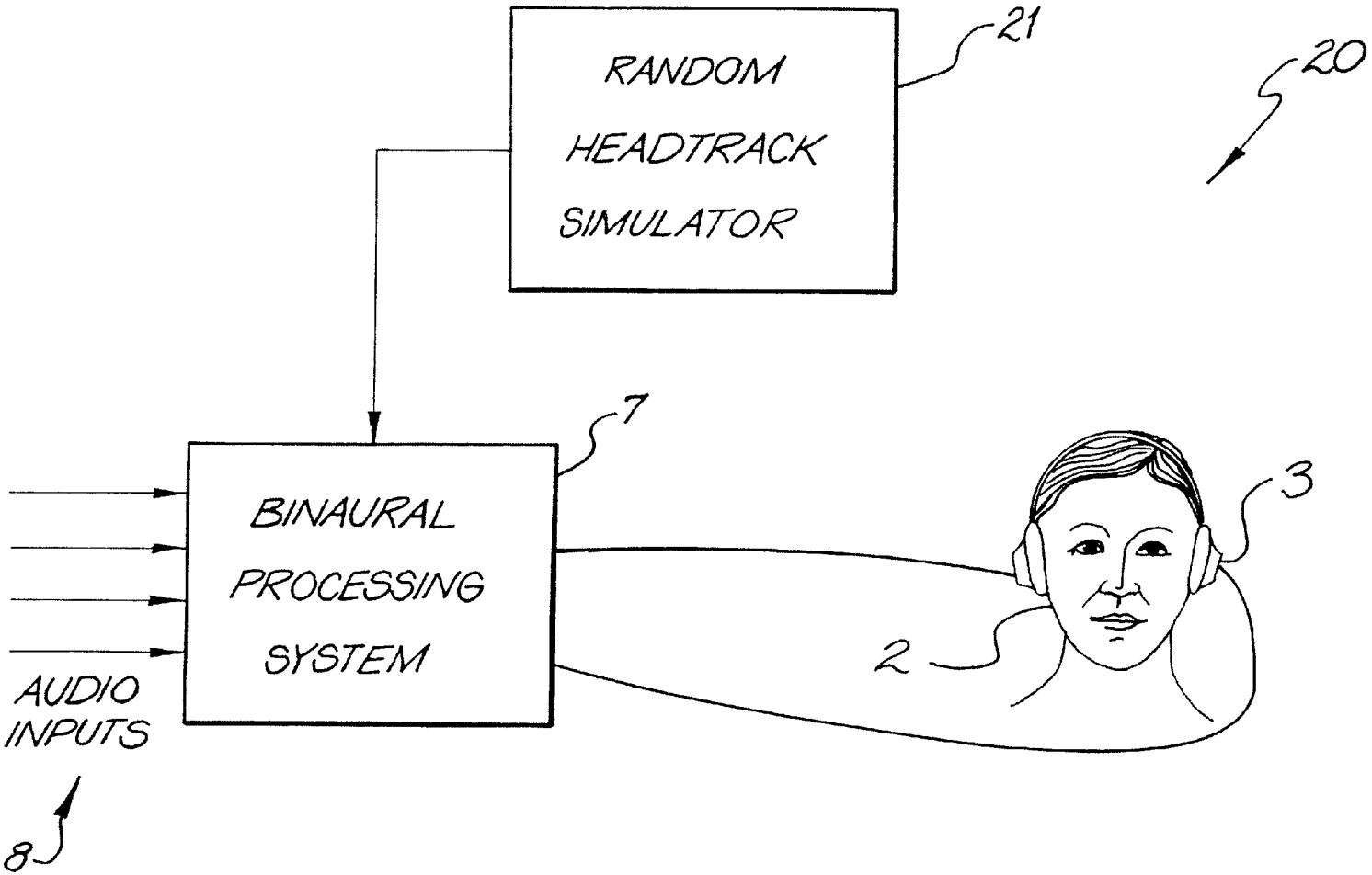
FIG. 2 illustrates a first embodiment suitable for use as the preferred embodiment.

In the preferred embodiment, the binaural processing system that was previously capable of operating with a head tracking unit is utilised with a "phantom" headtracking input which provides a random function that simulates movement. Referring now to FIG. 2, there is shown suitable form of the preferred embodiment 20 which dispenses with the headtracker 5 of FIG. 1 and replaces it with the random head track simulator 21. Given that the binaural processing system can be often implemented in the form of suitable programming of a DSP chip arrangement, the random head track simulator 21 is conveniently implemented in software. The random headtrack simulator 21 is designed to simulate the random movement of a user's head. Preferably, the degree of movement is generally limited to a small range of head angles (say +/−20°).

It has been found in practice that reproducing a binaural sound where the listener's head is assumed to be turning slightly from time to time leads to significantly improved results. When the binaural sound is played back to the listener, the movement of the virtual sources assists in creating the illusion of externalised sound sources. Also, the difference between front and rear virtual sound sources is more accentuated when they appear to move. Without wishing to be bound by theory, it is thought that this may be because the front-back discrimination process relies on subtle time delay, gain and equalization cues. The listener is thought to be very sensitive to small changes in these cues at each ear. Hence, the dynamic nature of the binaural effect enhances—its 3-D impression, even if the simulated head movements do not correlate with the listener's actual head movements.

As a further refinement, the random head movements may be based on typical head movement patterns (and may, in fact, be generated by using actual head movement measurements, to make them more realistic). Alternatively, as a further refinement, the random movements may be exaggerated, since in many real life situations (such as an audience watching a motion picture) the viewers do not generally turn their heads very much whilst sound is often projected all around a listener. A more exaggerated simulated movement may enhance the impression of 3-D sound, particularly the front/back sound experience.

As a further alternative refinement, the binaural processing system can simulate movement of the sources by altering the head related transfer function direction of arrival for each sound source without necessarily altering the time of arrival, which would normally happen in a real acoustic space. The altering of the time of arrival is preferably avoided as it can lead to disturbing comb filtering effects.

Figure 3:
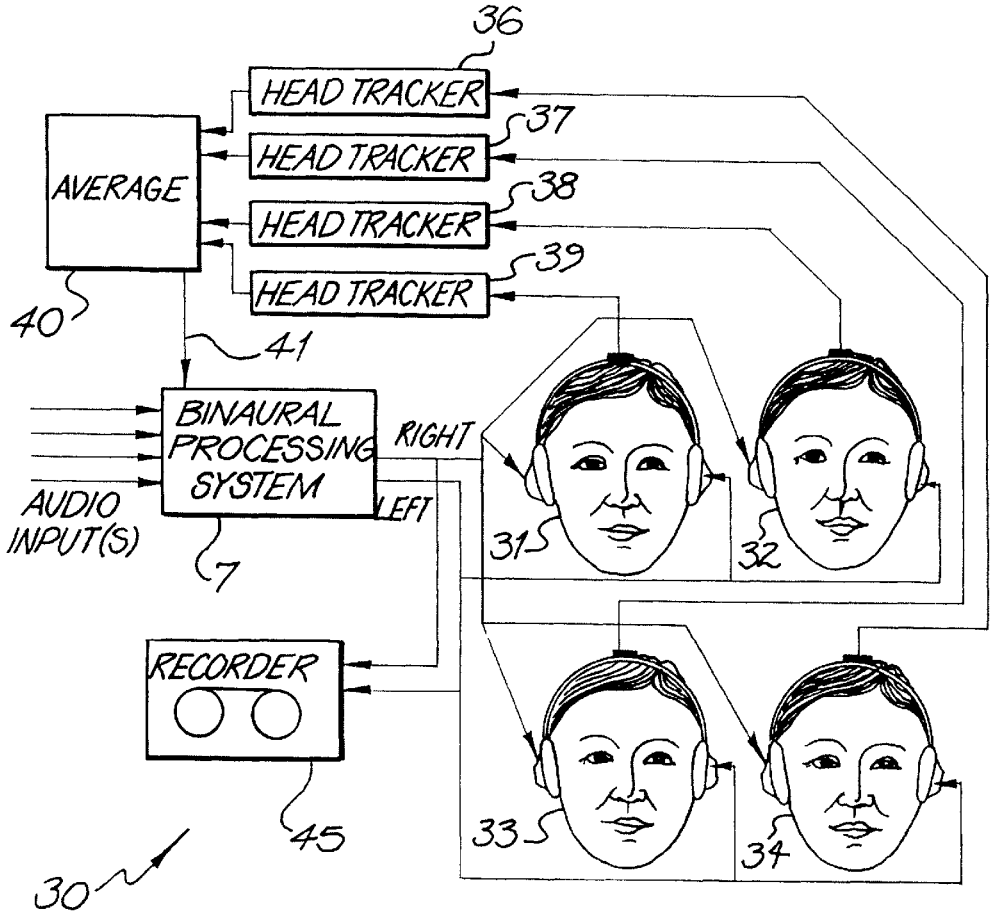
FIG. 3 illustrates a form of creating a recording in accordance with the principles of the preferred embodiment.

In many cases, it will be desired to playback the binaural sound to the listener with, for example, a video that accompanies the binaural sound track. This will cause a listener to turn their head in a manner that is not necessarily totally random and there is often some correlation between the image display and corresponding head movements. Referring now to FIG. 3, there is illustrated one form of arrangement to take advantage of this correlation. In the arrangement 30, a target audience of, for example, a movie audience are monitored utilising headtracking systems. Each listener 31–34 is provided with individual headtracking facilities including headtracking units 36–39. The output of the headtracking units 36–39 is then averaged 40 to produce a final averaged output 41 for forwarding to the binaural processing system which operates in the usual manner. The outputs of the binaural processing system 7 are also forwarded to a recording device 45 which records the left and right channels for later playback to an audience utilising only headphones. As many members of the audience in a cinema, for example, will move their head in a similar manner, following the movement of a character or object on the screen or reacting to sound events occurring at certain locations, the averaged output signal assists in the human auditory system decoding the audio inputs in a spatial sense. The recorded outputs 45 can then be later utilised with subsequent audiences in conjunction with the desired video imagery.

Figure 4:
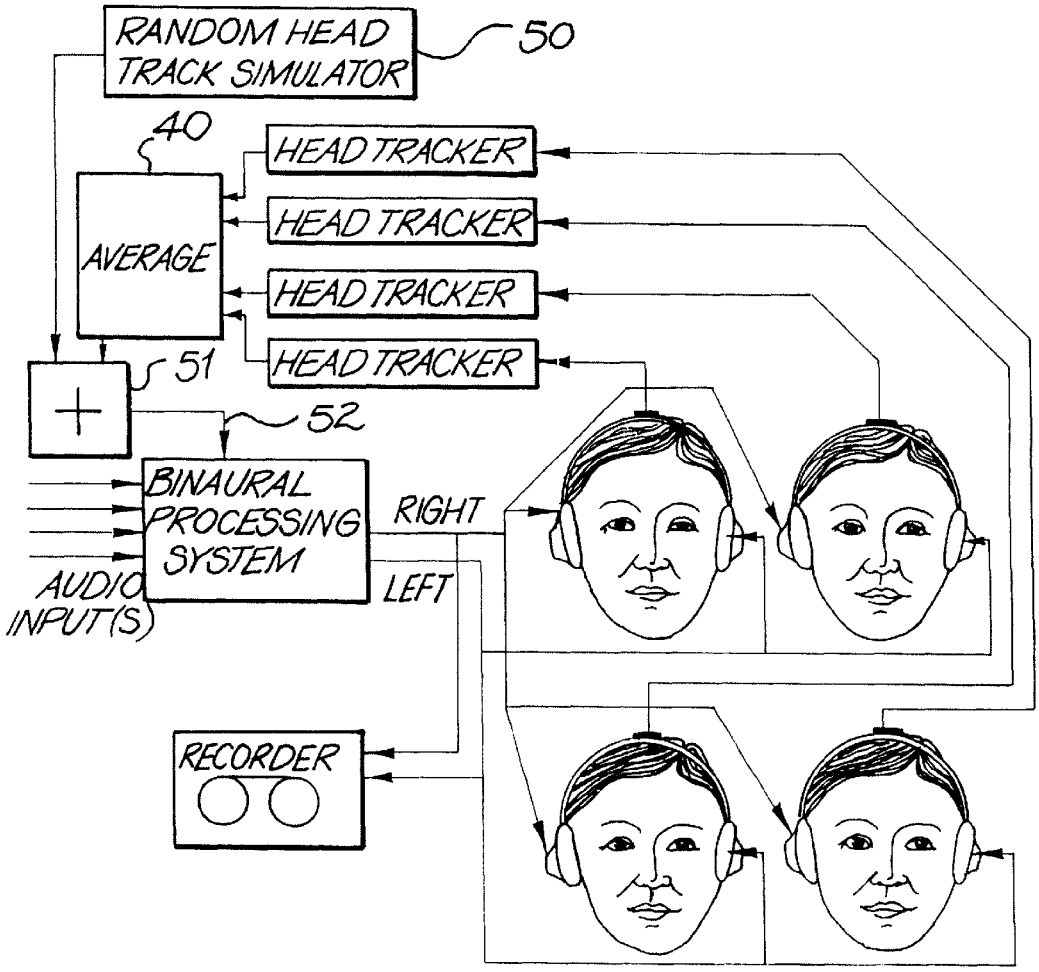
FIG. 4 illustrates an alternative embodiment for the creation of an audio recording in accordance with the principles of the present invention.

Referring now to FIG. 4, as a further refinement during times when the head movements of the listeners are reduced, such as when there is little motion or action in the video or motion picture image, a degree of random head movement can be added. In this respect, the output of averaging unit 40 is added to a random headtrack simulator 50 to produce a modified orientation signal 52 having the average component with a simulated extra random element.

From time to time, the virtual sound sources in a binaural presentation may also be moved through a larger distance, which assists further in forming an impression of frontal sound sources in particular. For example, a sound effect from the dialogue channel of a motion picture soundtrack might have its virtual location positioned at the listener's side, and then, while audio is being projected from this virtual sound location, the virtual location may be shifted to the front (where the dialogue channel normally belongs).

Moving the virtual sound source in this way achieves a better impression of a frontal sound image because (a) a moving sound source is easier to localise (and in particular, provides improved front-back discrimination) and (b) once the large scale movement is stopped (after the virtual sound source reaches its resting position in front), the listener's sensation of a frontal virtual image tends be sustained, particularly with the aid of visual cues, such as a motion picture.

It would be obvious to the skilled artisan t other combinations could be utilised. Further, the degree of mixture between the random head track simulator output and the average output could be varied in accordance with requirements and could indeed vary over the course of a video presentation.

It would be further appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

I claim:

1. A method for creating a multichannel audio signal that provides the impression of spatial sound to a listener of said audio signal, said method comprising:

providing an expected multichannel audio output signal having spatialized sound field components including a spatial position;

perturbing the spatial position of said spatialized sound field components independently of simultaneous orientation of the head of the listener, said perturbing including performing a set of spatial rotations having a substantially random component in a range of angular degrees of spatial rotation to said spatial position; and utilizing said perturbed sound field components to determine said multichannel audio signal.

2. A method as claimed in claim 1 wherein:

said perturbing further includes a set of spatial rotations derived from the head positions of a group of previous listeners to said audio signal.

3. A method for creating a multichannel audio signal that includes the impression of spatial sound to a set of listeners of said audio signal, said method comprising:

pre-processing a set of audio inputs for playback over a number of output channels to compensate for instantaneous varying head-direction cue movements of each of a plurality of sample listeners to produce a set of averaged pre-processed audio-inputs including averaged spatial compensation components derived from a plurality of spatial compensation components which spatially compensate for the instantaneous varying head-direction cue movements of each of the sample listeners; and at a later time playing said set of averaged pre-processed audio-inputs to a set of one or more new listeners independently of said sample listeners.

4. A method as claimed in claim 3 wherein:

said averaged pre-processed audio-inputs incorporate random components to provide statistically similar random movement patterns.

5. A method comprising:

providing a multichannel audio signal that that is spatialized according to a spatial position; and perturbing the spatial position of the spatialized audio signal according to a function of time independent of the orientation of the head of a listener, the perturbing of the spatial position including randomly rotating the position in a range of angles, the perturbing producing a perturbed multichannel of audio signal;

such that the perturbed multichannel audio signal gives an impression of spatial sound to the listener without the listener needing a head tracking device.

6. A method as claimed in claim 5 wherein:

said perturbing further includes rotating the position as a function of time derived from the head positions of a group of previous listeners as a function of time listening to the multichannel audio signal.

7. A method for creating an improved multichannel audio signal that includes an impression of spatial sound, said method comprising:

perturbing the spatial position of a spatialized first multichannel audio signal as a function of time, the perturbing being independent of the orientation of the head of a listener to produce a perturbed multichannel audio signal, the perturbing including varying the spatial position of the first multichannel audio signal in time according to a pre-determined average position as a function of time, the pre-determined average position previously obtained by averaging the position of a set of sample listeners as a function of time while the sample listeners listen to the first multichannel audio signal, such that playing back the perturbed multichannel audio signal to a new listener independently of the set of sample listeners produces an impression of spatial sound to the new listener.

8. A method as claimed in claim 7 wherein:

the perturbing includes randomly varying the position in time independent of the head position of the new listener.

* * * * *

UNITED STATES PATENT AND TRADEMARK OFFICE

CERTIFICATE OF CORRECTION

PATENT NO. : 6,718,042 B1
DATED : April 6, 2004
INVENTOR(S) : McGrath

It is certified that error appears in the above-identified patent and that said Letters Patent is hereby corrected as shown below:

Column 4,
Line 25, change “artisan t other” to -- artisan that many other --.

Column 5,
Line 9, “random components to provide” to -- random components so as to provide --.

Signed and Sealed this

Twenty-seventh Day of July, 2004

JON W. DUDAS
*Acting Director of the United States Patent and Trademark Office*